US005599212A

United States Patent [19]

Sawada

[11] Patent Number: 5,599,212

[45] Date of Patent: Feb. 4, 1997

[54] SOCKET TERMINAL

[75] Inventor: Yoshitsugu Sawada, Shizuoka, Japan

[73] Assignee: Yazaki Corporation, Tokyo, Japan

[21] Appl. No.: 396,588

[22] Filed: Mar. 1, 1995

Related U.S. Application Data

[63] Continuation of Ser. No. 243,927, May 17, 1994, abandoned.

[30] Foreign Application Priority Data

May 17, 1993 [JP] Japan ..... 5-136966

[51] Int. Cl.[6] ..... H01R 13/187

[52] U.S. Cl. ..... 439/843; 439/852

[58] Field of Search ..... 439/842–848, 439/851–857, 861, 862

[56] References Cited

U.S. PATENT DOCUMENTS

| | | | |
|---|---|---|---|
| 4,466,688 | 8/1984 | Singer et al. | 439/825 |
| 4,734,064 | 3/1988 | Knapp et al. | 439/852 |
| 5,051,108 | 9/1991 | Lincoln | 439/825 |
| 5,188,545 | 2/1993 | Hass et al. | 439/851 |
| 5,322,459 | 6/1994 | Spinnato | 439/843 |
| 5,334,058 | 8/1994 | Hotea | 439/851 |

FOREIGN PATENT DOCUMENTS

| | | |
|---|---|---|
| 63-11751 | 3/1988 | Japan . |
| 63-102182 | 5/1988 | Japan . |

*Primary Examiner*—David L. Pirlot

*Attorney, Agent, or Firm*—Sughrue, Mion, Zinn, Macpeak & Seas

[57] ABSTRACT

A female terminal body consists of elastic contact pieces which are separated from each other in a peripheral direction by slits elongating in a longitudinal direction, a cylindrical base portion for fixing a sleeve, a conductor clamping portion to which a conductor of an electric wire W is to be fixed, and a wire cover clamping portion. The elastic contact pieces are disposed in a front part of the terminal body, the cylindrical base portion in a middle part, and the conductor clamping portion and the wire cover clamping portion in a rear part. The elastic contact pieces elongating from the cylindrical base portion constitute a cylinder having a diameter which gradually decreases as moving more distant from the cylindrical base portion, so that the male terminal is pressingly contacted to and clamped by their front ends. In order to facilitate the insertion of the male terminal, the front end portion of the cylinder has a diameter which gradually increases. The cylindrical base portion is formed into a rectangular cylindrical shape. A press fitting receiving portion is disposed at a predetermined position of each of edges of the cylindrical base portion.

3 Claims, 4 Drawing Sheets

SOCKET TERMINAL

This is a continuation of application Ser. No. 08/243,927 filed May 17, 1994 now abandoned.

BACKGROUND OF THE INVENTION

1. Field of Invention

The invention relates to a method of fitting a protection sleeve for covering elastic contact pieces for clamping a male terminal, onto a female terminal body, and particularly to a socket terminal in which the female terminal body can easily be worked and is prevented from being misaligned in a fitting process with respect to the protection sleeve.

2. Related Art

Conventionally, as a generally used socket terminal, known is a round-pin terminal having a circular cylindrical shape and disclosed in, for example, Examined Japanese Patent Publication Sho. 63-11751. The round-pin terminal has an excellent workability because it has no particular limitations other than the connecting direction.

As shown in FIG. 8, a female terminal body 1 consists of a plurality of elastic contact pieces 2 which are separated from each other in a peripheral direction by slits S elongating in a longitudinal direction, a cylindrical base portion 3 onto which a protection member is to be fitted, a conducting portion la, a conductor clamping portion 4 to which an electric wire W is to be fixed, and a cover clamping portion 5. The elastic contact pieces 2 are disposed in a front part of the terminal body 1, the cylindrical base portion 3 and the conducting portion 1*a* in a middle part, and the conductor clamping portion 4 and the cover clamping portion 5 in a rear part. The terminal body 1 is formed by punching a flat conductive material and plastic-deforming the punched material into a circular cylindrical shape. In order to facilitate the insertion of a male terminal M, the front ends of the elastic contact pieces 2 are bent outward.

A circular cylindrical protection sleeve 6 is fitted onto the cylindrical base portion 3 through an annular pad 7, thereby protecting the elastic contact pieces 2. The sleeve 6 has a terminal insertion hole 6*b* at the front end. A terminal lock portion 6*a* for the fitting onto the cylindrical base portion 3 is formed at the rear end of the sleeve 6.

As shown in FIG. 9, the elastic contact pieces 2 is inserted into the sleeve 6 from an opening of the terminal lock portion 6*a*, while putting the annular pad 7 into contact with the front ends 2*a* of the elastic contact pieces 2. Then, the sleeve 6 is fixed by forming a press fitting 6*c* at a predetermined position on the sleeve 6 which corresponds to a press fitting portion 3*a* formed between the cylindrical base portion 3 and the elastic contact pieces 2.

However, a conventional socket terminal has problems as follows. When such a female terminal body having a round shape is produced by a general press working, particularly when the conducting portion 1*a* is formed by a conventional method, a difficult bending process is required in order to continuously conduct a drawing process, and it is difficult to produce and work a mold, whereby the production cost is increased and a defective is easily produced. Since an external stress is easily concentrated in the boundary between the conductor clamping portion 4 and the conducting portion 1*a* on which the drawing process is conducted, moreover, there is a possibility of causing damages such as that the terminal body is broken off during transportation.

SUMMARY OF THE INVENTION

The invention has been conducted in view of the problems in the conventional art. It is an object of the invention to provide a socket terminal in which a female terminal body can be formed by a simple bending process without impairing the strength of the terminal.

The above-mentioned object of the invention can be attained by a socket terminal comprising: a terminal body having a cylindrical base portion in a front part, and a wire connection portion in a rear part, the cylindrical base portion having a plurality of elastic contact pieces which are separated from each other in a peripheral direction by slits elongating in a longitudinal direction, a wire being to be connected to the wire connection portion; and a circular cylindrical protection sleeve having a terminal insertion hole at a front part, and a fitting portion at a rear part, the protection sleeve being fitted onto the cylindrical base portion, wherein the cylindrical base portion of the terminal body is formed into a rectangular cylindrical shape, a press fitting receiving portion is disposed at a predetermined position of each of edges (ridge line) of the cylindrical base portion, and outer portions of the sleeve corresponding to the press fitting portions are press-fitted after the sleeve is fitted onto the cylindrical base portion.

Furthermore, the object can be attained by a configuration wherein the length of a diagonal line of a section of the cylindrical base portion is slightly smaller than an inner diameter of the sleeve, the section being perpendicular to the longitudinal direction.

Moreover, the object can be attained by a configuration wherein each of the press fitting receiving portions is a small hole disposed at a predetermined position of a flat conductive material which is punched into a predetermined shape.

In the socket terminal of the invention, since the cylindrical base portion of the terminal body is formed into a rectangular cylindrical shape, and the press fitting receiving portion is disposed at a predetermined position of each of edges of the cylindrical base portion, the cylindrical base portion can easily be formed by a simple straight bending process. Since the sleeve is fitted onto the cylindrical base portion while being guided by the four edges of the cylindrical base portion, furthermore, misalignment between the front ends of the elastic contact pieces and the terminal insertion hole of the sleeve does not occur. Since the outer portions of the sleeve corresponding to the press fitting portions are press fitted, moreover, the sleeve can surely be fixed to the terminal body so that there arises no trouble in the fitting process of male and female terminals.

DETAILED DESCRIPTION OF THE PREFERRED EMBODIMENTS

Figure 1:
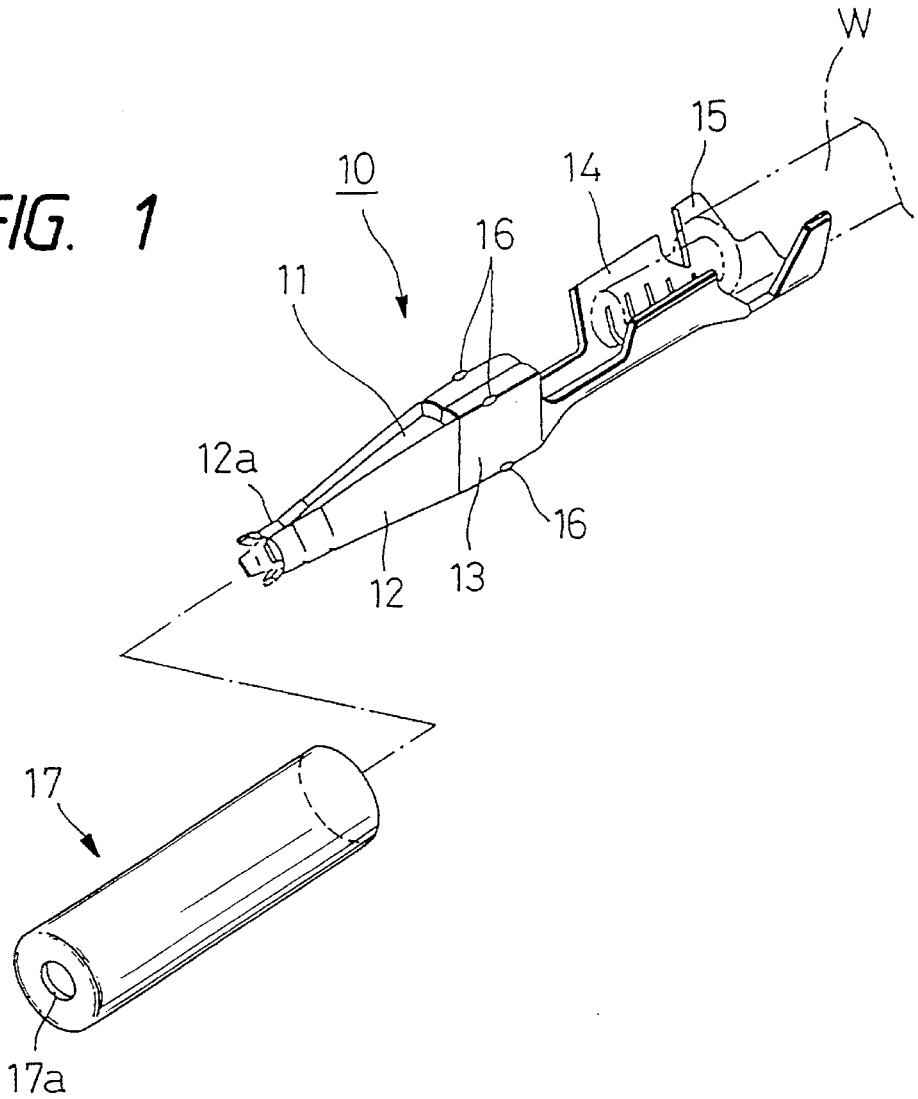
FIG. 1 is an exploded perspective view of a socket terminal of an embodiment of the invention.
Figure 2:
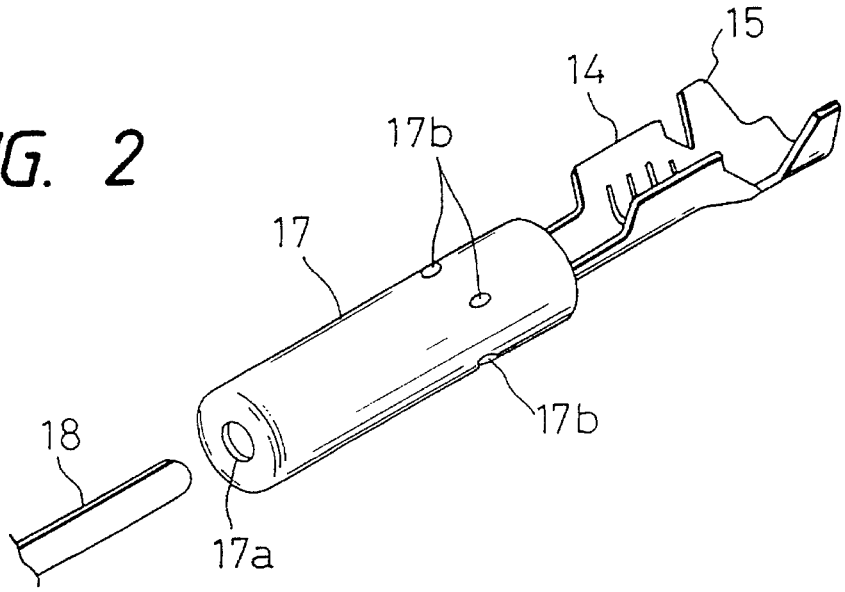
FIG. 2 is a perspective view showing a state where a sleeve is fitted onto a female terminal body and caulked.
Figure 4:
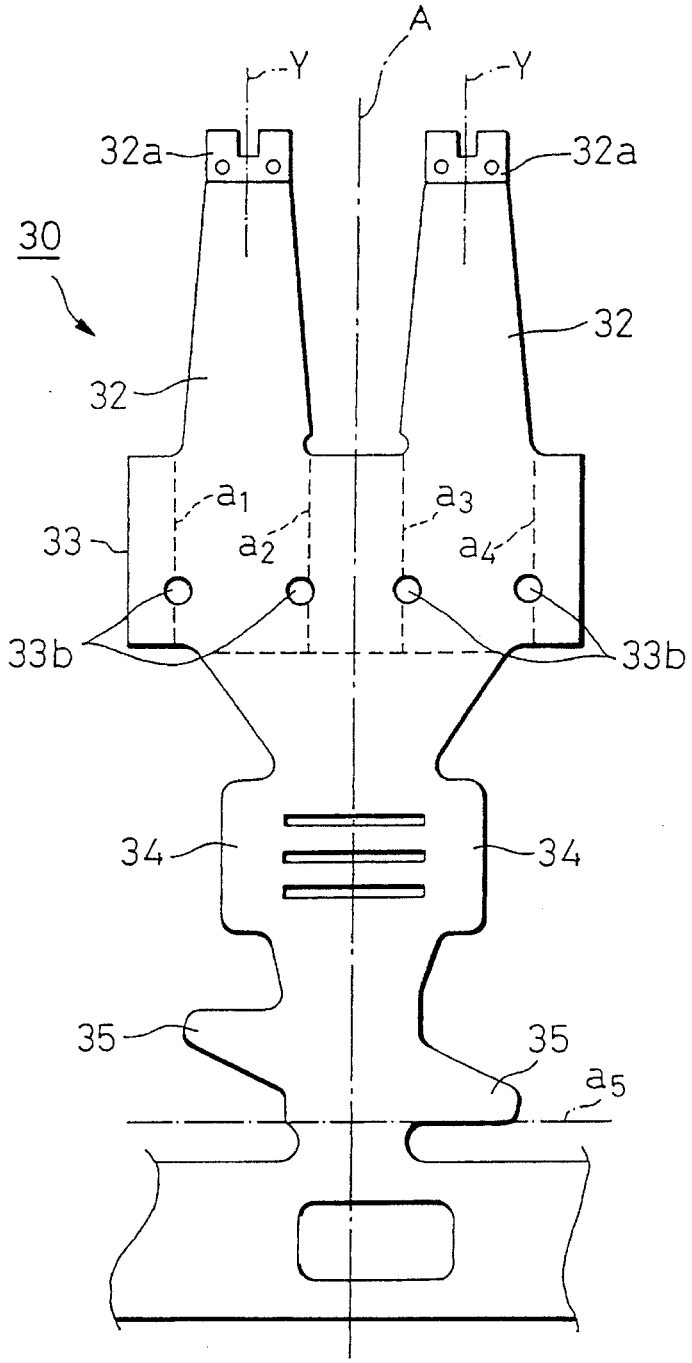
FIG. 4 is a development of the female terminal body.
Figure 5:
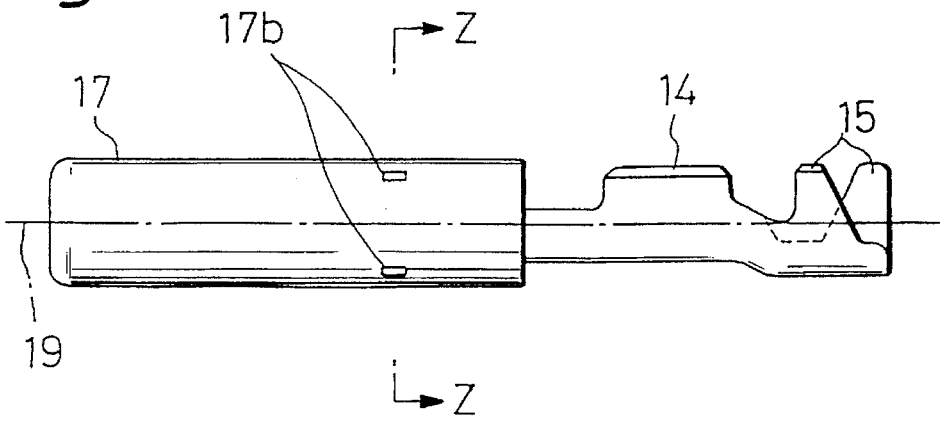
FIG. 5 is a side view of FIG. 2.
Figure 6:
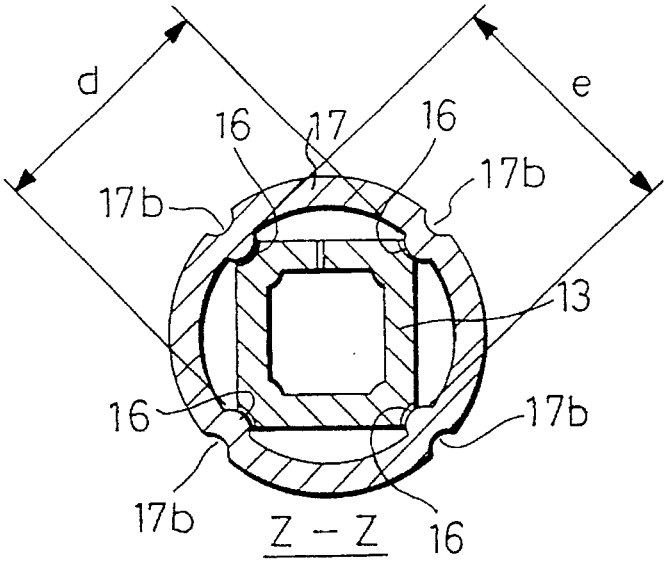
FIG. 6 is a section view taken along line Z—Z of FIG. 5.
Figure 7:
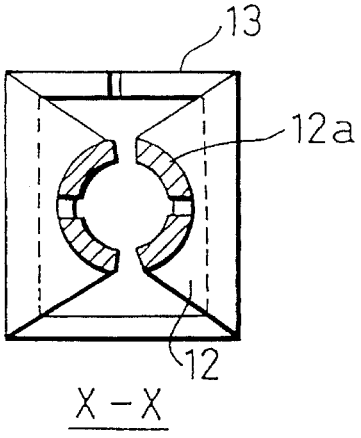
FIG. 7 is a section view taken along line X—X of FIG. 3.
Figure 8:
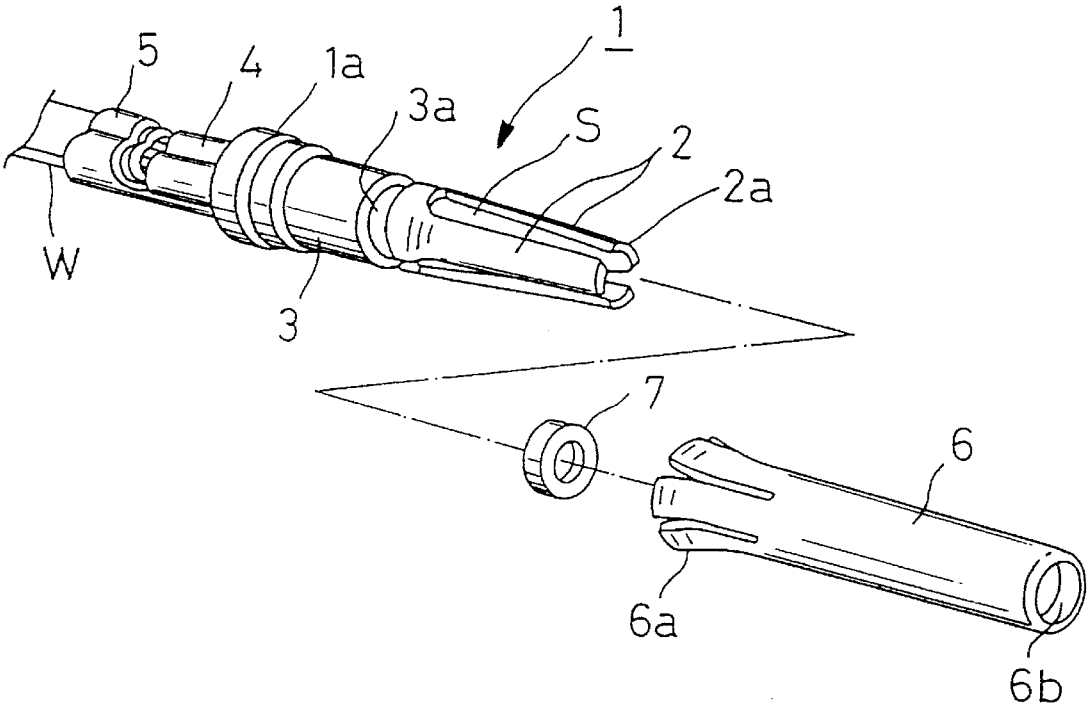
FIG. 8 is an exploded perspective section view of a socket terminal of a conventional example.
Figure 9:
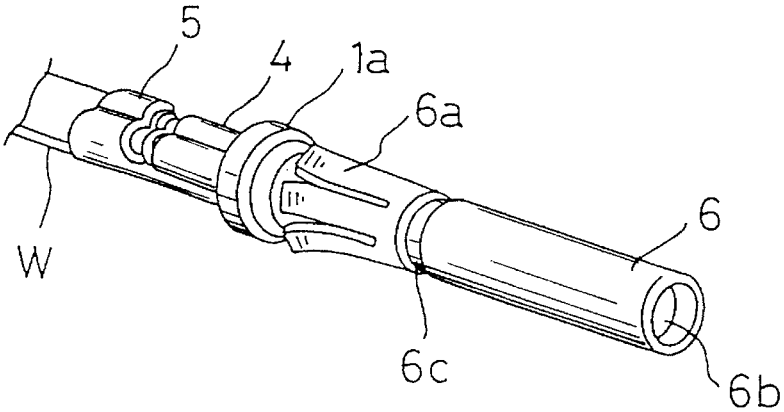
FIG. 9 is a perspective view showing a state in which the sleeve of FIG. 8 is fitted onto the female terminal body and caulked.

Hereinafter, a socket terminal which is an embodiment of the invention will be described with reference to FIGS. 1 to 7. FIG. 1 is an exploded perspective view of a socket terminal of the embodiment of the invention, FIG. 2 is a perspective view showing a state where a sleeve is fitted, FIG. 3 is a plan view of the terminal body, FIG. 4 is a development of the terminal body, FIG. 5 is a side view of FIG. 2, FIG. 6 is a section view taken along line Z—Z of FIG. 5, and FIG. 7 is a section view taken along line X—X of FIG. 3.

As shown in FIG. 1, the terminal body 10 comprises elastic contact pieces 12 which are separated from each other in a peripheral direction by slits 11 elongating in a longitudinal direction, a cylindrical base portion 13 for fitting a sleeve, a conductor clamping portion 14 to which a conductor of an electric wire W is to be fixed, and a cover clamping portion 15. The elastic contact pieces 12 are disposed in a front part of the terminal body 10, the cylindrical base portion 13 in a middle part, and the conductor clamping portion 14 and the cover clamping portion 15 in a rear part.

On the other hand, the sleeve 17 which is a circular cylindrical protection member opens at the rear end so that the elastic contact pieces 12 can be inserted into the sleeve. A terminal insertion hole 17*a* which functions as an insertion hole for the male terminal is formed at the front end of the sleeve 17.

Figure 3:
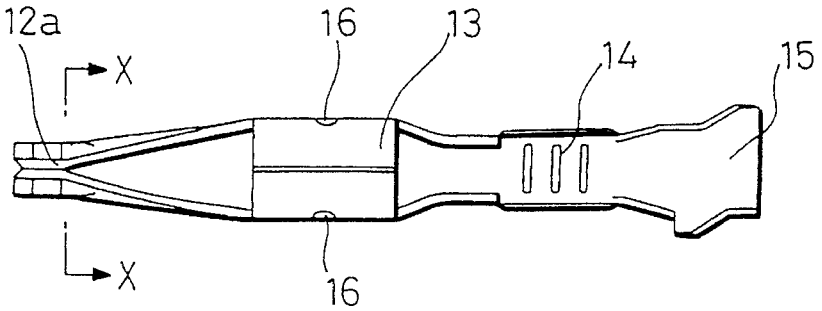
FIG. 3 is a plan view of the female terminal body.

As shown in FIG. 3, the elastic contact pieces 12 elongating from the cylindrical base portion 13 constitute a cylinder having a diameter which gradually decreases as moving more distant from the cylindrical base portion 13, so that the male terminal is pressingly contacted to and clamped by their front ends 12*a*. In order to facilitate the insertion of the male terminal, the front end portion of the cylinder has a diameter which gradually increases. The cylindrical base portion 13 is formed into a rectangular cylindrical shape having a rectangular section. A press fitting receiving portion 16 is disposed at a predetermined position of each of edges of the cylindrical base portion 13.

As shown in FIGS. 2 and 5, the elastic contact pieces 12 of the female terminal body 10 are inserted from the opening at the rear end of the sleeve 17. After the front ends 12*a* contact with the terminal insertion hole 17*a* at the front end of the sleeve 17, portions on the outer face of the sleeve 17 respectively corresponding to the press fitting receiving portions 16 of the cylindrical base portion 13 are fixed by press fitting 17*b*. Under this state, the axes of the sleeve 17 and cylindrical base portion 13 are made coincident with the axis 19. Consequently, the axis 19 passes the center of the terminal insertion hole 17*a* for the male terminal 18 which hole is formed at the front end of the sleeve 17, and therefore the male terminal 18 is correctly inserted and fitted into the center of the female terminal body 10.

As shown in FIG. 4, the female terminal body 10 is formed by subjecting a blank 30 punched from a flat metal plate which is elastic and conductive, to a press working.

A cylindrical base portion 33 of the blank 30 is straightly folded in a perpendicular direction toward the inside about a center line A along folding lines $a_1$, $a_2$, $a_3$, and $a_4$ indicated by broken lines, so that the cylindrical base portion 13 is formed into a rectangular cylindrical shape which has a rectangular section. The press fitting receiving portions 16 formed on the edges of the cylindrical base portion 13 are respectively constituted by small holes 33*b* formed in the blank 30, and used for conducting the press fitting on the outside portion of the sleeve 17 after the cylindrical base portion 13 is inserted into the sleeve 17.

Each of the elastic contact pieces 12 is formed by inwardly bending a contact piece portion 32 of the blank 30 into an arcuate shape about a longitudinal center line Y of a front end portion 32*a*, so that, when the male terminal is inserted, the male terminal is elastically clamped and held (see FIG. 7).

The conductor clamping portion 14 for fixing the conductor of the electric wire W, and the cover clamping portion 15 are formed by a conductor clamping portion 34, and a cover clamping portion 35, respectively. The female terminal body is cut off along a line $a_5$.

As shown in FIG. 6, after the sleeve 17 is fitted onto the female terminal body 10, the sleeve is press fitted from the outside at positions corresponding to the press fitting receiving portions 16 formed on the edges of the cylindrical base portion 13. This press fitting process causes the press fitting projections 17*b* projecting from the inner face of the sleeve 17 to engage with the press fitting receiving portions 16, whereby the sleeve 17 is fixed to the female terminal body 10 under the state their axes coincide with each other. Consequently, the center of the terminal insertion hole 17*a* of the sleeve 17 exists on the axis of the front ends 12*a* of the elastic contact pieces 12, and hence the misalignment between the axis and the center does not occur.

The length d of a diagonal line of a perpendicular section of the cylindrical base portion 13 is slightly smaller than the inner diameter e of the sleeve 17. Accordingly, the operation of fitting the sleeve 17 onto the cylindrical base portion 13 can easily be conducted.

As described above, according to the invention, the cylindrical base portion of the terminal body is formed into a rectangular cylindrical shape, the press fitting receiving portion is disposed at a predetermined position of each of edges of the cylindrical base portion, and outer portions of the sleeve corresponding to the press fitting receiving portions are press fitted after the sleeve is fitted onto the cylindrical base portion. Therefore, the cylindrical base portion can be formed by a straight bending process so that the terminal can easily be produced and the production cost can greatly be reduced. Since portions, such as the boundary between the conductor clamping portion where an external stress is concentrated and the conductor portion on which the drawing process is performed are ensured to have a sufficient strength, moreover, it is possible to produce a female terminal which is free from a deformation or damage such as bending or which has a high strength, and the rate of defectives is remarkably reduced. Since the center aligning between the front ends of the elastic contact pieces and the terminal insertion hole of the sleeve is facilitated and they are prevented from being misaligned, furthermore, elastic contact pieces, etc. are prevented from being deformed or damaged when the male terminal is fitted into the female terminal.

What is claimed is:

1. A socket terminal comprising:

a terminal body having:

a cylindrical base portion in a front part, the cylindrical base portion having a plurality of elastic contact pieces which are separated from each other in a peripheral direction by slits elongating in a longitudinal direction, the cylindrical base portion being formed into a rectangular cylindrical shape;

a wire connection portion in a rear part, a wire being to be connected to the wire connection portion;

a press fitting receiving portion arranged on the cylindrical base portion; and a circular cylindrical protection sleeve having a terminal insertion hole at a front part and a fitting portion at a rear part, the circular cylindrical protection sleeve being fitted onto the cylindrical base portion by press fitting at a portion corresponding to the press fitting receiving portion.

2. A socket terminal as claimed in claim 1, wherein the length of a diagonal line of a section of the cylindrical base portion is slightly smaller than an inner diameter of the circular cylindrical protection sleeve, the section being perpendicular to the longitudinal direction.

3. A socket terminal as claimed in claim 1, wherein the press fitting receiving portion includes a small hole disposed at a ridge line of the cylindrical base portion.

* * * * *